United States Patent [19]

Petty

[11] 4,338,688

[45] Jul. 13, 1982

[54] ENCLOSURE FOR TUB DRAINS

[75] Inventor: William T. Petty, Rutherford, Tenn.

[73] Assignees: Elbert L. Petty; Lloyd F. Petty, both of Rutherford; Robert M. Petty, Kenton, all of Tenn.

[21] Appl. No.: 175,580

[22] Filed: Aug. 5, 1980

[51] Int. Cl.[3] ..... A47K 17/00; E03C 1/00

[52] U.S. Cl. ..... 4/191; 4/661

[58] Field of Search ..... 4/661, 559, 584, 191, 4/193, 194, 612, 613, 538, 592, 595

[56] References Cited

U.S. PATENT DOCUMENTS

| | | | |
|---|---|---|---|
| 2,130,930 | 9/1938 | Rose | 137/362 X |
| 2,236,104 | 3/1941 | McIntosh | 137/361 |
| 2,256,780 | 9/1941 | McIntosh | 137/361 |
| 2,938,216 | 5/1960 | Murray | 137/362 X |
| 3,020,922 | 2/1962 | Oury | 137/362 X |
| 3,474,810 | 10/1969 | Welsh | 137/362 X |
| 3,633,219 | 1/1972 | Byrd | 137/363 |

*Primary Examiner*—Henry K. Artis

*Attorney, Agent, or Firm*—B. P. Fishburne, Jr.

[57] ABSTRACT

A prefabricated metallic open top box with attached top flanges and bottom wall threaded nipple surrounds the tub drain components and excludes insects and mice from the space beneath the tub. Odors are also excluded from this area by the enclosure. The threaded nipple is readily coupled to the tub drain and descending pipe. The use of the enclosure eliminates the need for constructing a form around the tub drain prior to pouring the concrete floor.

1 Claim, 4 Drawing Figures

ENCLOSURE FOR TUB DRAINS

BACKGROUND OF THE INVENTION

The present invention has for its main object to satisfy a need for a simplified and practical means for enclosing a bathtub drain where the tub is installed on either a wood or concrete floor. In either case, the purpose of the drain enclosure is to prevent insects and other vermin, as well as odors, from entering upwardly through the floor and into the bathroom through the floor opening usually formed around the tub drain. No known prior art device can accomplish the objective of the invention as above stated.

A further object is to provide a simple and inexpensive tub drain enclosure in the form of a prefabricated sheet metal rectangular drain box, open at its top and equipped with top marginal mounting flanges and an attached vertical axis threaded nipple on the bottom wall of the enclosure near one end thereof which can be readily coupled with the tub drain and descending pipe beneath the floor.

Another object is to provide a tub drain enclosure which serves as a form for concrete poured around a tub drain in the making of a concrete floor.

Other features and advantages of the invention will become apparent during the course of the following detailed description.

DETAILED DESCRIPTION

Figure 1:
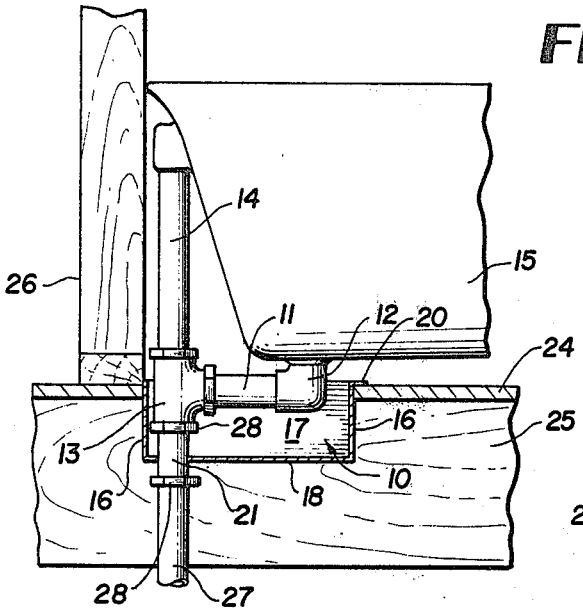
FIG. 1 is a vertical section through a tub drain enclosure where the enclosure is mounted on a wooden floor.

Referring to the drawings in detail wherein like numerals designate like parts, a tub drain enclosure or box 10 formed of heavy sheet metal is rectangular and somewhat elongated to accept the horizontal tub drain pipe 11, drain elbow 12 and drain tee 13 connected with the usual overflow pipe 14 leading from the top of the bathtub 15.

The drain enclosure 10 is open at the top and includes end and side walls 16 and 17 and a horizontal bottom wall 18. Attached to the top edges of the two side walls 17 and one end wall 16 are narrow right angular outwardly projecting mounting flanges 19 and 20, all at a common elevation and extending around three sides of the enclosure or box.

Attached to the bottom wall 18 near and inwardly of the end wall 16 without a top flange and midway between the side walls 17 is a vertical axis nipple 21 which extends equidistantly above and below the bottom wall

18 and has its upper and lower end portions screw-threaded as at 22. The nipple 21 can be welded at 23 within a provided opening in the bottom wall 18 and is thus sealed within the opening. The enclosure with its flanges 19 and 20 and attached nipple 21 is unitary and rigid. The dimensions of the enclosure including its length, width and height may vary to suit particular needs.

FIG. 1 shows the drain enclosure 10 installed beneath the bathtub on a wooden sub-floor 24 supported on joists 25. The top flanges 19 and 20 rest on the sub-floor 24 and the flange-less end wall 16 may be placed close to any adjacent wall framing or stud 26. The enclosure 10 surrounds the drain components 11, 12 and 13 and effectively excludes insects, mice and the like as well as odors from entering the bathroom through the floor. The attached nipple 21 is readily coupled to the drain tee 13 and the adjacent descending pipe 27 by conventional slip joint nuts and gaskets 28.

Figure 2:
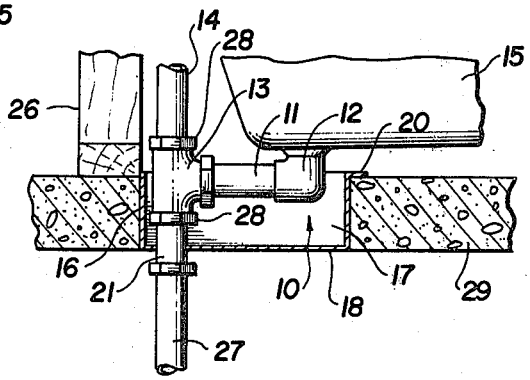
FIG. 2 is a similar view showing the enclosure included in a concrete floor.
Figure 3:
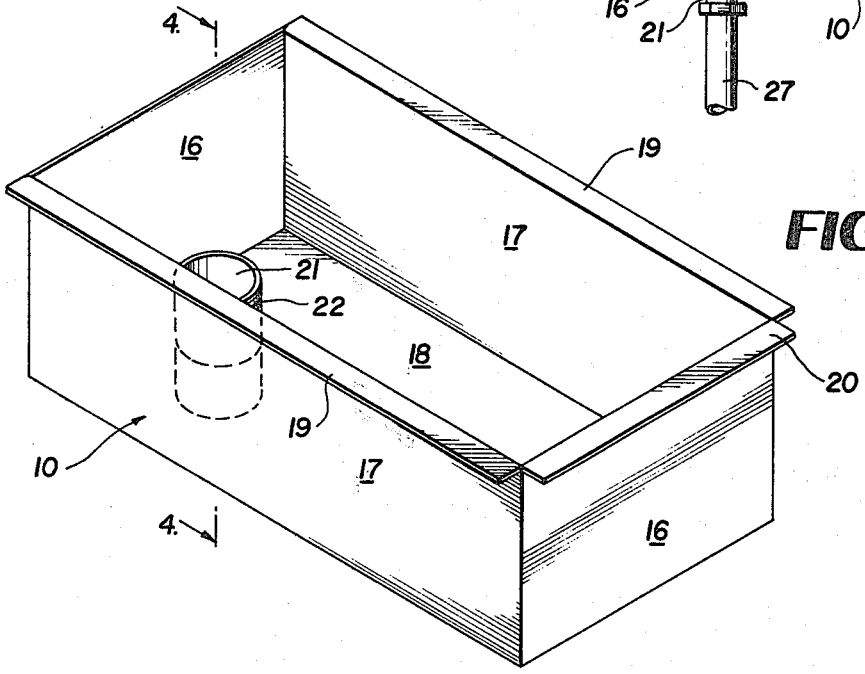
FIG. 3 is a perspective view of the drain enclosure or box according to the invention.
Figure 4:
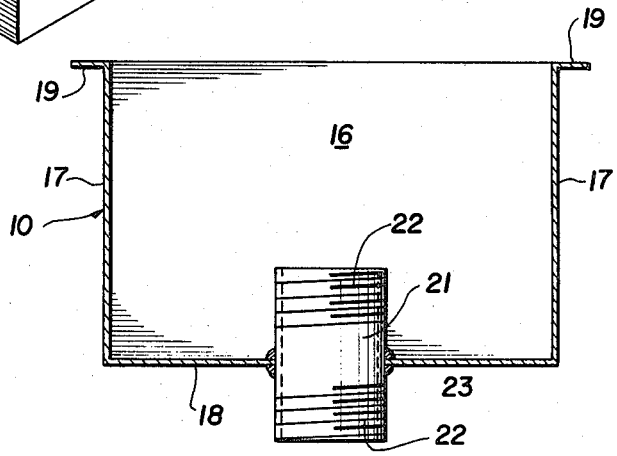
FIG. 4 is a vertical section taken on line 4—4 of FIG. 3.

FIG. 2 shows the described tub drain enclosure 10 installed with a concrete floor 29. In this situation, the drain enclosure obviates the necessity for a concrete form to be constructed around the tub drain prior to pouring the concrete floor. In effect, the enclosure 10 serves a dual purpose and constitutes a form around the drain components, as well as a means of excluding insects, vermin and odors.

In either type of installation, the invention is characterized by low cost of manufacturing, simplicity of construction, and ease and convenience of installation. It is very efficient in achieving its stated objectives.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A dry enclosure for bath tub drains operable to exclude vermin and odors from entering a bathroom where the tub is situated through a floor opening adjacent to the drain, the dry enclosure comprising a rectangular open top box adapted to fit snugly into a floor opening and having at its top and around three of its sides only a narrow outwardly directed right angular support flange for the enclosure adapted to rest on the bathroom floor immediately surrounding the margin of the floor opening, the wall of said enclosure without said flange adapted to fit snugly against adjacent wall framing, and a tubular nipple anchored in the bottom wall of the box and projecting above and below said bottom wall substantially equidistantly and having its top end terminating within the box well below the open top thereof, the opposite ends of said nipple being threaded and adapted to be threadedly coupled within the box to an element of the tub drain and below the bottom wall of the box to a descending waste pipe.

* * * * *